United States Patent [19]

Wheeler

[11] Patent Number: 4,503,566

[45] Date of Patent: Mar. 12, 1985

[54] LEG PROTECTOR

[75] Inventor: Hudson L. Wheeler, Northfield, Ill.

[73] Assignee: Wheeler Protective Apparel, Inc., Chicago, Ill.

[21] Appl. No.: 546,560

[22] Filed: Oct. 28, 1983

[51] Int. Cl.[3] ..... A41D 17/00

[52] U.S. Cl. ..... 2/22; 36/2 R

[58] Field of Search ..... 2/22, 242, 36, 240, 2/241, 16, 23; 36/58.5, 1, 2 R; 128/165

[56] References Cited

U.S. PATENT DOCUMENTS

| | | | |
|---|---|---|---|
| 1,003,077 | 9/1911 | Watson | 36/2 R |
| 1,004,812 | 10/1911 | Pfouts | 36/2 R |
| 2,249,553 | 7/1941 | Cataffo | 2/22 |
| 2,733,443 | 2/1956 | Holder | 2/22 |
| 2,832,074 | 12/1955 | Wheeler | 2/16 X |
| 2,872,745 | 8/1956 | Finegan | 36/2 R |
| 3,128,565 | 8/1961 | Graham et al. | 36/2 R |
| 3,153,864 | 10/1962 | Brewer | 36/2 R |
| 3,241,153 | 10/1963 | Brewer | 2/22 |
| 3,605,122 | 2/1969 | Myers | 2/242 |
| 3,845,749 | 11/1974 | Shaw | 128/165 |

FOREIGN PATENT DOCUMENTS

| | | | |
|---|---|---|---|
| 73367 | 7/1928 | Fed. Rep. of Germany | 36/2 R |
| 462783 | 2/1914 | France | 36/2 R |
| 578425 | 9/1924 | France | 36/2 R |
| 1124735 | 10/1956 | France | 2/22 |
| 306717 | 2/1929 | United Kingdom | 36/2 |

*Primary Examiner*—Henry S. Jaudon
*Assistant Examiner*—Mary A. Ellis
*Attorney, Agent, or Firm*—Hill, Van Santen, Steadman & Simpson

[57] ABSTRACT

A protective leg and shoe covering is provided which has a two piece upper portion designed to snuggly wrap around a user's lower leg and a flare portion to cover the top of the user's shoe. A hook and pile closure provides adjustability in the snugness of the fit and a metal stay with an exposed end capturable in a heel pocket provides an additional degree of protection. The flare portion is held in place by an adjustable chain. The device is light weight and is easy and quick to put on and take off.

8 Claims, 7 Drawing Figures

LEG PROTECTOR

BACKGROUND OF THE INVENTION

1. Field of the Invention

The present invention relates to protective wearing apparel and more particularly to exterior apparel for the protection of legs and feet against molten metal contact.

2. Description of the Prior Art

In some manufacturing environments, for instance pouring operations found in steel mills and foundries, molten metal splashes into areas where workers are walking or standing while performing their work functions. Because the molten metal can cause severe burns if it comes into contact with a person's skin, there have been provided devices to shield portions of the worker's body which may be exposed to the molten metal or suseptible of being burned. One such type of protection which has been provided is a foot and leg protector to prevent the molten metal from contacting the lower portion of a worker's leg or his foot, particularly to prevent the metal from flowing into his shoes or boots.

Available leg protectors are generally constructed of one piece of material which has a portion to surround the leg and another portion which covers the top of the shoe. The prior devices are deficient in that they do not all fit snugly at the top end which allows molten splash to run down inside of the leg protector and also they do not include provisions to hold the flare portion which covers the top of the shoe down over the shoe. Thus, although the worker may be wearing a protective device, protection is not always provided and the risk of injury is still present.

The state of the prior art is examplified by U.S. Pat. No. 2,832,074 issued Apr. 29, 1938.

SUMMARY OF THE INVENTION

The present invention provides leg protectors which are easy to put on and quick to take off and which provide snug fitting at the top of the protector and also provide a means for holding the flare portion down against the top of the user's shoe.

The leg protectors are made of a fire resistant material and have a two piece upper portion which affords accommodation of the present invention to both a spat and/or a legging. In either form of the invention a metal stay is provided in the upper portion and fits in a heel pocket in one of three selected positions for adjusting to the size of the shoe and foot of the user. A wide hook and pile closure device is provided at the ends of the wrap-around leg protector so that the size is adjustable and the top of the protector can be made snug. The closure extends the entire height of the protector to seal off the top against splash.

A pull tab is provided to release the hook and pile closure and to pull the exposed end of the metal stay from the heel pocket to allow the protector to slide off the shoe.

The flare covering the top of the shoe is made of a special fire or heat-resistant, stiff material. To insure that the flare stays down, securing means are provided that can take the form of a chain secured at the instep side of the protector. A hook or catcher is secured to an opposite side. The chain is slid under the instep and drawn up against the hook on the other side to securely hold the flare over the instep or shoe lace area. This holds the flare in place and prevents it from flipping up, and possibly allowing molten splash to enter the worker's shoe.

DESCRIPTION OF THE PREFERRED EMBODIMENTS

The principles of the invention are applicable to both the spat length or legging length protectors.

Figure 1:
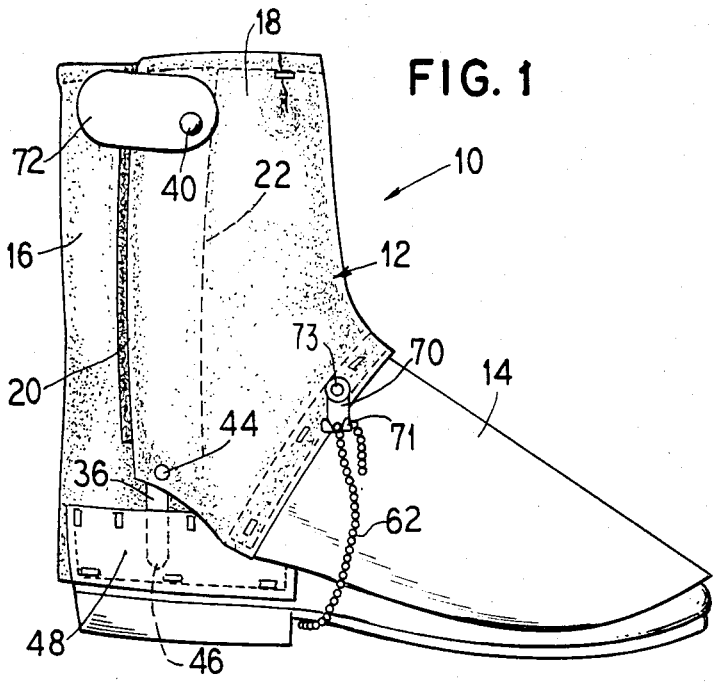
FIG. 1 is a side elevational view of a spat length embodying the principles of the invention leg protector in place on a shoe of a user.
Figure 2:
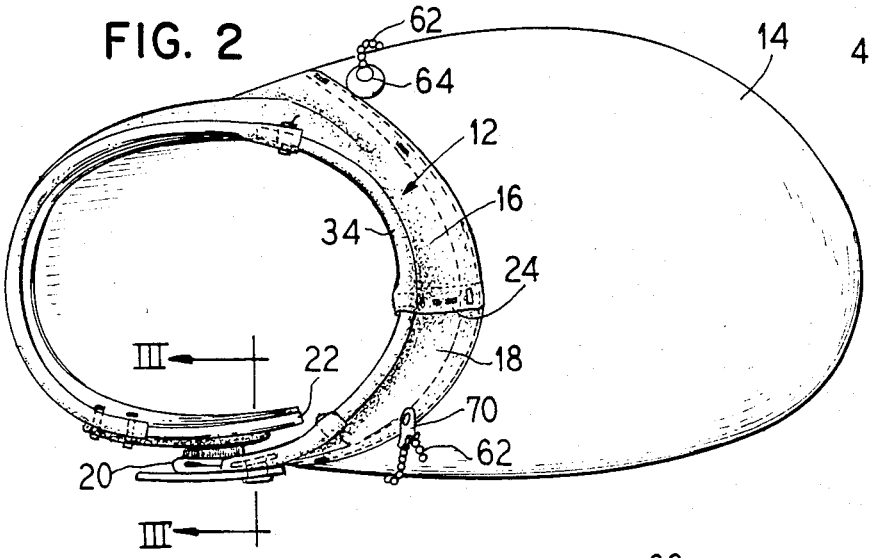
FIG. 2 is a top elevational view of the leg protector of FIG. 1.

In FIG. 1 there is shown a leg protector device generally at 10 which is comprised of a spat length upper portion 12 and a flare portion 14. As FIG. 2 shows, the upper portion 12, which is constructed of a first piece 16 and a second piece 18 sized and shaped to be of a spat configuration for wrapping around the lower leg or ankle area of a user so that a free end 20 of the second part overlaps a free end 22 of the first part 16.

Figure 4:
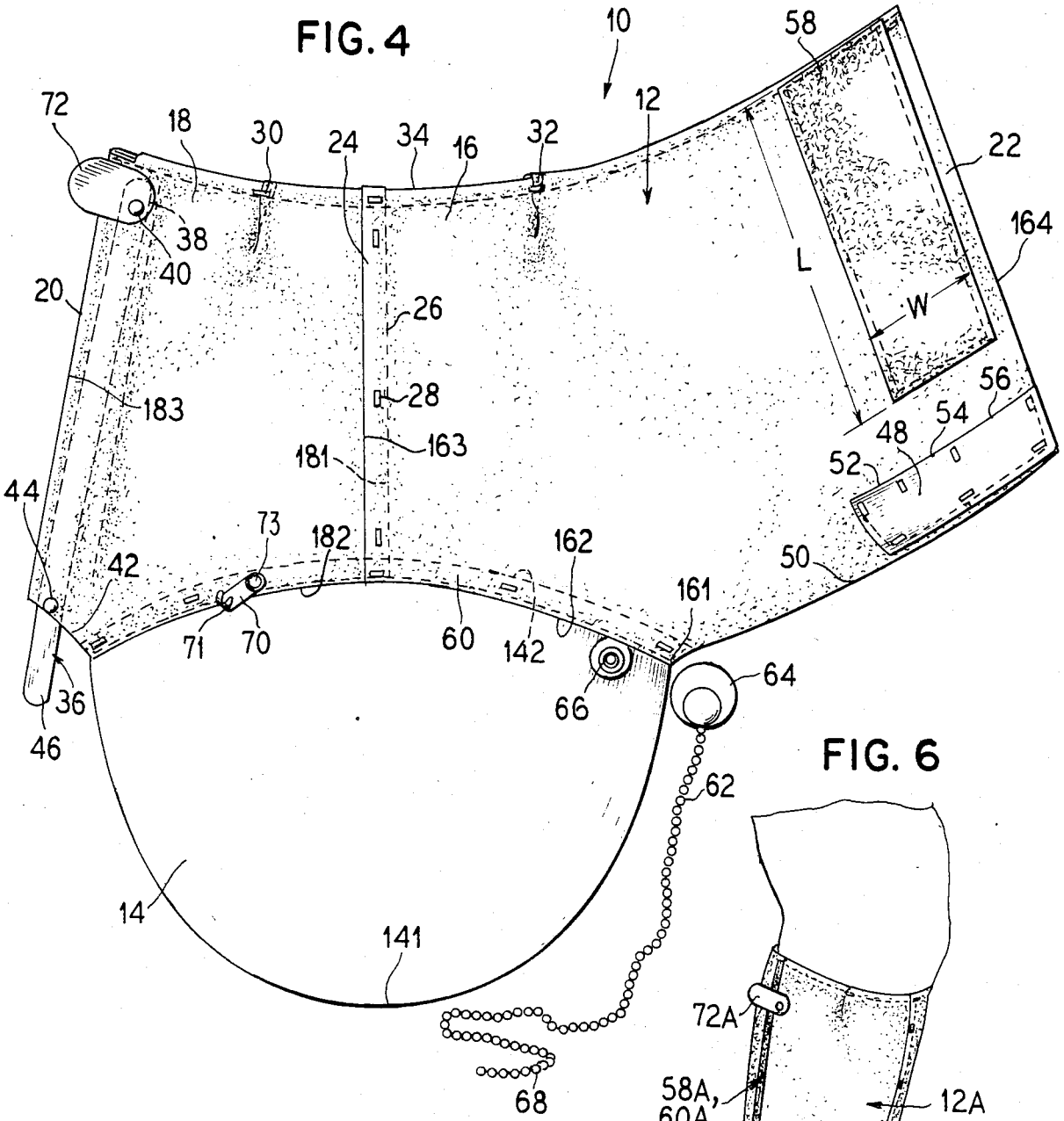
FIG. 4 is a plan view of the leg protector laid open and flattened out.

The two-part construction of the upper portion 12 allows for tapering of the upper portion as it wraps around the wearer's leg to provide a more custom and snug fit. Thus, as shown in the development of FIG. 4, the part 16 has a shape of an irregular geometric form outlined by a lower edge so terminating at one end at 161 where the edge extends upwardly and curvately as at 162 to the outside edge 163. the opposite outside edge is shown at 164.

The part 18 has outside edges 181 and 183 and a lower edge curved as at 182 to match the curved edge 162 and notched or relieved as at a straight lower edge 42 to accommodate the projecting end of the stay.

The first and second pieces 16, 18 of the upper portion 12 are fastened together at a seam 24 by appropriate means such as stitches 26 and staples 28. The tapering effect is further enhanced by tacks 30, 32 along a top edge 34 of the upper portion 12.

Secured near the overlying edge 20 of the second piece 18 is a metal stay 36 which is secured at a top end 38 by an appropriate fastener 40 such as a rivet. The top end 38 of the stay 36 is closely adjacent the top edge 34 of the upper portion 12 which extends between the edges 163 and 164 and between the edges 181 and 183. The metal stay 36 is also secured near a lower edge 42 of the upper portion 12 by a fastening means 44 such as a rivet. The metal stay 36 extends beyond the lower edge 42 of the upper portion and has an exposed protrusion 46.

When the leg protector is in place on the user's leg, the exposed protrusion 46 of the stay 36 is captured in a heel pocket 48 which is secured near a bottom edge 50 of the first piece 16 of the upper portion 12 and adjacent the free edge 22. The heel pocket 48 is shown in FIG. 4 as having three individual pockets 52, 54 and 56 which may be selectively used for capturing and holding the exposed end 46 of the stay 36 depending on the size of the foot and shoe of the user. In this manner, the bottom of the free ends 20 and 22 of the upper portion 12 are held in relatively fixed relationship.

Figure 3:
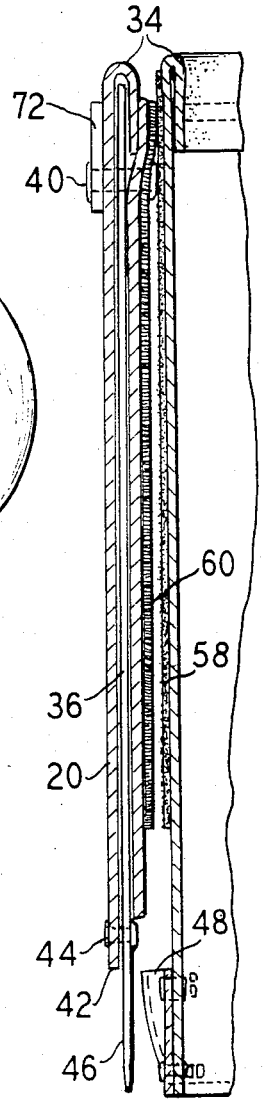
FIG. 3 is a sectional view of a closure area of the leg protector taken generally along the lines III—III of FIG. 2.
Figure 5:
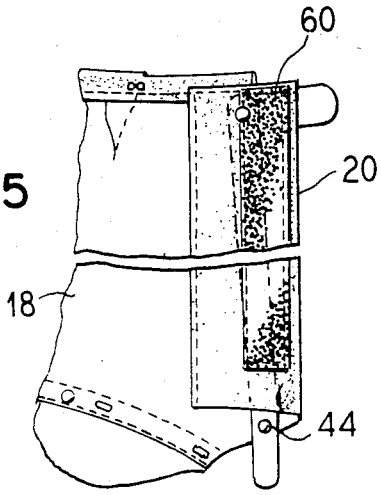
FIG. 5 is a partial elevational rear view of the closure area of the protector.

To secure the upper end of the free edges 20 and 22 of the upper portion 12 as well as the points in-between, a hook and pile type closure is utilized as is seen in FIGS. 3, 4 and 5. One commercially available form of such closure is referred to under the trademark "VELCRO". The pile material 58 may be attached adjacent to the free edge 22 of the first piece 16 to extend through a length "L" from the top edge 34 of the upper portion down to about near the top of the heel pocket 48. The corresponding hook material 60 is shown in FIG. 5 as being secured near the free edge 20 of the second piece 18. The hook material also extends approximately the entire height of the free edge 20 to provide for continuous gripping action along the height of the upper portion. The pile material 58 has a relatively wide width "W" to allow for adjustability and the placement of the hook material in selected overlapping relationship. The width allows for the upper portion to be fitted snugly throughout a range of variable sizes.

In development, (FIG. 4) the flare 14 is shown to be a sheet-form member having an arcuate edge 141 forming essentially a semi-circle and an arcuate edge 142 of a much larger radius of curvature. The flare portion 14 of the leg protector is secured to the upper portion 12 along a seam 60 which can be formed by appropriate means such as stitching and stapling extending through the border portions adjacent the edge 142. The flare 14 is fabricated of a stiff heat resistant material and is sized to form an apron or shield which will substantially cover the entire top portion of the user's shoe with the curved edge 141 extending generally downwardly and forwardly over the toes of the user. To hold the flare portion 14 snugly against the top of the shoe, there is provided a chain 62 which can be secured at a first end 64 to the flare 14 by means of a snap fastener 66 or permanently by means of a rivet. A free end 68 of the chain 62 is slipped under the user's shoe and is captured on the opposite side of the flare by a hook or catcher 70 which is mounted on the flare by means of a rivet 73 and having a clevis 71 sized to obtain a purchase on the chain 62. The chain provides for adjustability to the snugness of the flare with respect to the shoe and allows for the leg protectors to be easy and quick to be put on and take off.

A tab 72 is secured by the rivet 40 near the top edge 34 of the free edge 20 and has a portion projecting into an accessible location so it selectively can be easily grasped by the user to pull the overlapping edge 20 away from the underlying edge 22 and thereby separating the hook and pile fasteners and withdrawing the stay protrusion 46 from the heel pocket 48.

Figure 6:
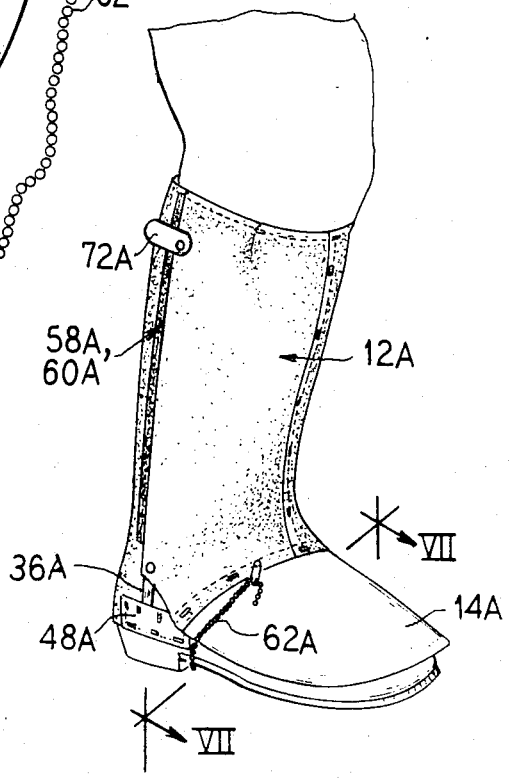
FIG. 6 is a perspective view of an alternative embodiment of a legging length leg protector.
Figure 7:
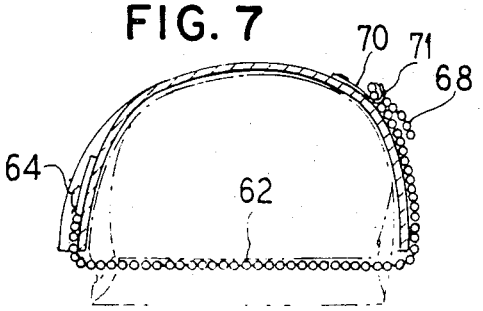
FIG. 7 is a sectional view of the chain closure device taken generally along the lines VII—VII of FIG. 6.

FIG. 6 shows an alternative embodiment of the present invention in which the upper portion 12A is made of legging length and extends upwardly and encloses nearly the entire lower leg area of the user up to the knee. Corresponding elements are proportioned accordingly so that in respects the leg protector as shown in FIG. 6 is the same as that described in connection with FIGS. 1–5. The flare portion 14A covers the user's shoe and is held against the shoe by the chain 62A. The metal stay 36A is provided to ensure that the upper portion stays in position around the user's leg is securely captured in the heel pocket 48A. The pull tab 72A is also provided for quick and easy release of the closure means 58A, 60A.

The leg protector of the present invention is light weight, easy and quick to put on and take off, and it also provides a greater degree of protection than existing protective footwear. The different features of the inventive device can be used singly or in combination to provide the necessary or desired protective qualities.

As is apparent from the foregoing specification, the invention is susceptible of being embodied with various alterations and modifications which may differ particularly from those that have been described in the preceding specification and description. It should be understood that I wish to embody within the scope of the patent warranted hereon all such modifications as reasonably and properly come within the scope of my contribution to the art.

I claim as my invention:

1. A leg covering comprising:

first and second upper parts, and a flare part, said flare part comprising a sheet-form member made of heat-resistant material and shaped in development to have a first generally circular edge and a second edge of shallower curvature, said first and second upper parts each comprising a sheet-form member of heat-resistant material and being of irregular rectangular configuration and having curved edge portions complementary to said second edge of said flare, fastening means for pemanently connecting said curved edge portions to said first and second upper parts to said second edge of said flare part, and connecting adjacent inner overlapping vertical edges of said upper parts to one another, one of said upper parts carrying a metal stay extending generally vertically adjacent an outer edge of said one part and projecting below a relieved lower edge portion of said one part for capture and retention of said projecting portion of said stay in a pocket formed in a lower portion of the other of said upper parts and aligned to register with said projecting portion of said stay when the two upper parts are wrapped around the leg of a user, hook and pile fastening means extending along vertical opposite edges of said upper parts and being of sufficient width to afford circumferential adjustability relative to the leg of a user, fastening means connected to said leg covering extending beneath the shoe of the user and having selectively engageable detent means to lock the flare portion over the instep and toes of the user, and a tab with a manually engageable portion near the top of one of said upper parts to facilitate detachment of said hook and pile fastening means for easy removal of the leg protector.

2. A leg protector as defined in claim 1 wherein said upper parts are of spat length.

3. A leg protector as defined in claim 1 wherein said upper parts are of legging length.

4. A protective leg and shoe covering comprising:

an upper portion constructed to wrap around a lower portion of a user's leg with a first end overlapping a second end, said upper portion fabricated from two pieces of flexible heat resistant material, a flare portion securely attached to said upper portion and constructed to overlie and cover a user's shoe, said flare portion being fabricated from a piece of stiff heat resistant material, first securing means for providing a snug fit at the top of said upper portion against the user's leg, and a separate second securing means for providing a snug fit at the bottom of said upper portion, said second securing means comprising a protrusion extending from the lower end of said first end which can be captured and secured by one of a plurality of pockets in said second end.

5. The device of claim 4 wherein said first securing means comprises a wide hook and pile fastening means with the hook means attached to one of said ends and the pile means attached to the other of said ends.

6. The device of claim 4 wherein a metal stake carried vertically in said first end is used to ensure that said upper portion stays in position against the user's leg.

7. The device of claim 4 including means for retaining said flare portion against the user's shoe wherein said retaining means is selectively adjustable.

8. The device of claim 4 wherein said first securing means includes means for selectively adjusting the degree of overlap of said ends.

* * * * *